US007857406B2

(12) United States Patent
Komai

(10) Patent No.: US 7,857,406 B2
(45) Date of Patent: Dec. 28, 2010

(54) INKJET HEAD DRIVING APPARATUS AND DRIVING METHOD

(75) Inventor: Yasuhito Komai, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 484 days.

(21) Appl. No.: 12/051,093

(22) Filed: Mar. 19, 2008

(65) Prior Publication Data

US 2008/0252672 A1 Oct. 16, 2008

(30) Foreign Application Priority Data

Apr. 12, 2007 (JP) ..... 2007-105223

(51) Int. Cl.
*B41J 29/38* (2006.01)

(52) U.S. Cl. ..... 347/11; 347/9; 347/10

(58) Field of Classification Search ..... 347/9–11
See application file for complete search history.

(56) References Cited

U.S. PATENT DOCUMENTS 6,193,343 B1 * 2/2001 Norigoe et al. ..... 347/11
7,195,327 B2 * 3/2007 Kitami et al. ..... 347/11

FOREIGN PATENT DOCUMENTS

JP 2000-015802 1/2000

* cited by examiner

*Primary Examiner*—Julian D. Huffman
*Assistant Examiner*—Jason S Uhlenhake
(74) *Attorney, Agent, or Firm*—Turocy & Watson, LLP

(57) ABSTRACT

An inkjet head driving apparatus which drives an inkjet head for use in gradation printing which is performed to cause a capacity of each of a plurality of pressure chambers filled with ink to be changed by a drive pulse applied to an actuator, an ink drop to be emitted onto a recording medium from a nozzle communicating with the corresponding pressure chamber, and the number of ink drops emitted to be controlled according to the number of drive pulses, the driving apparatus including a drive signal generating section which applies a deboost pulse to decrease pressure in the pressure chamber before the drive pulse for emitting a first drop of ink is applied, wherein the deboost pulse includes a pulse applied to expand or contract the capacity of the pressure chamber for a predetermined length of time, and a quiescent time following the pulse.

20 Claims, 9 Drawing Sheets

| | The number of drops | | | | | | |
|---|---|---|---|---|---|---|---|
| | 1 | 2 | 3 | 4 | 5 | 6 | 7 |
| Single-nozzle drive | 8.0 | 7.7 | 8.1 | 8.3 | 8.1 | 8.3 | 8.3 |
| Multi-nozzle drive | 8.1 | 5.0 | 6.9 | 7.1 | 7.7 | 7.6 | 7.9 |

[m / s]

Assigned value

| | | | |
|---|---|---|---|
| Emission speed (first drop) | 8.1 | m / s | |
| Emission speed (second drop) | 5.0 | m / s | |
| Gap | 1 | mm | GAP : distance between head and printing medium (shooting distance of ink drop) |
| Drop period | 7.3 | us | DC : time required to emit one drop |
| Conveyance speed | 0.406 | m / s | V : conveyance speed of printing medium |

FIG. 3A

Calculation value

| | | | |
|---|---|---|---|
| Projecting time (first drop) | 123.5 | us | T1d : projecting time of first drop of ink |
| Projecting time (second drop) | 200.0 | us | T2d : projecting time of second drop of ink |
| Delay when drop strikes | 83.8 | us | Tdelay=T2d+DC-T1d : Difference between when first drop of ink strikes and when second drop of ink strikes |
| Difference in striking position | 34.0 | um | L=V*Tdelay : difference in position between first and second drops |

FIG. 3B

INKJET HEAD DRIVING APPARATUS AND DRIVING METHOD

CROSS-REFERENCE TO RELATED APPLICATIONS

This application is based upon and claims the benefit of priority from prior Japanese Patent Application No. 2007-105223, filed Apr. 12, 2007, the entire contents of which are incorporated herein by reference.

BACKGROUND OF THE INVENTION

1. Field of the Invention

The present invention relates to an inkjet head driving apparatus and an inkjet driving method.

2. Description of the Related Art

Generally, in order to perform high quality printing, an inkjet printer utilizes an area gradation system, such as a dither system. This system forms a matrix of plural dots, namely a pixel, without changing the size of an ink drop and represents gradation by different numbers of dots in pixels. The system obtains gradation higher than a certain level at the expense of resolution.

Another known technology is a density gradation system, which changes the density of one dot by changing the size of an ink drop. This system does not sacrifice resolution but involves a difficult technology in seeking to control the size of ink drops.

A so-called multi-drop drive system is also known. In this system, the number of ink drops projected per dot is changed without changing the size of individual drops, thereby creating density gradation. This system involves no sacrifice of gradation and obviates the need to control the size of ink drops. Accordingly, this system can be comparatively easily realized from a technical point of view (refer to Japanese Patent No. 2931817.

BRIEF SUMMARY OF THE INVENTION

According to a first aspect of the present invention, there is provided an inkjet head driving apparatus which drives an inkjet head for use in gradation printing which is performed to cause a capacity of each of a plurality of pressure chambers filled with ink to be changed by a drive pulse applied to an actuator, an ink drop to be emitted onto a recording medium from a nozzle communicating with the corresponding pressure chamber, and the number of ink drops emitted to be controlled according to the number of drive pulses, the driving apparatus comprising: a drive signal generating section which, when the number of the ink drops is smaller than a predetermined number N (wherein $1<N\leqq M$, and M is the number of ink drops at the maximum gradation), applies a deboost pulse to decrease pressure in the pressure chamber before the drive pulse for emitting a first drop of ink is applied and, when the number of the ink drops is equal to or greater than the predetermined number N, does not apply the deboost pulse, wherein the deboost pulse includes an expansion pulse applied to expand the capacity of the pressure chamber for a predetermined length of time or a contraction pulse applied to contract the capacity of the pressure chamber for a predetermined length of time, and a quiescent time following the expansion or contraction pulse.

According to a second aspect of the present invention, there is provided an inkjet head driving apparatus which drives an inkjet head for use in gradation printing which is performed to cause a capacity of each of a plurality of pressure chambers filled with ink to be changed by a drive pulse applied to an actuator, an ink drop to be emitted onto a recording medium from a nozzle communicating with the corresponding pressure chamber, and the number of ink drops emitted to be controlled according to the number of drive pulses, the driving apparatus comprising: drive signal generating means for, when the number of the ink drops is smaller than a predetermined number N (wherein $1<N\leqq M$, and M is the number of ink drops at the maximum gradation), applying a deboost pulse to decrease pressure in the pressure chamber before the drive pulse for emitting a first drop of ink is applied and, when the number of the ink drops is equal to or greater than the predetermined number N, applying no deboost pulse, wherein the deboost pulse includes an expansion pulse applied to expand the capacity of the pressure chamber for a predetermined length of time or a contraction pulse applied to contract the capacity of the pressure chamber for a predetermined length of time, and a quiescent time following the expansion or contraction pulse.

According to a third aspect of the present invention, there is provided an inkjet head driving method for driving an inkjet head for use in gradation printing which is performed to cause a capacity of each of a plurality of pressure chambers filled with ink to be changed by a drive pulse applied to an actuator, an ink drop to be emitted onto a recording medium from a nozzle communicating with the corresponding pressure chamber, and the number of ink drops emitted to be controlled according to the number of drive pulses, the driving method comprising: a drive signal generation step of, when the number of the ink drops is smaller than a predetermined number N (wherein $1<N\leqq M$, and M is the number of ink drops at the maximum gradation), applying a deboost pulse to decrease pressure in the pressure chamber before the drive pulse for emitting the first drop of ink is applied and, when the number of the ink drops is equal to or greater than the predetermined number N, applying no deboost pulse, wherein the deboost pulse includes an expansion pulse applied to expand the capacity of the pressure chamber for a predetermined length of time or a contraction pulse applied to contract the capacity of the pressure chamber for a predetermined length of time, and a quiescent time following the expansion or contraction pulse.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 3A shows various given values used in calculation of differences in striking position;

FIG. 3B shows values obtained by the calculation of differences in striking position;

DETAILED DESCRIPTION OF THE INVENTION

First Embodiment

Figure 14:
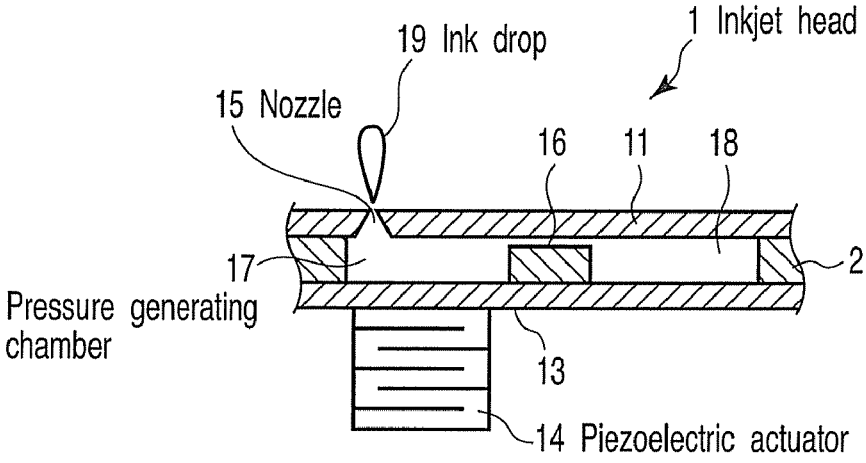
FIG. 14 shows a conventional inkjet head.

FIG. 14 shows an inkjet head. An inkjet head 1 includes: a plurality of pressure generating chambers 17 filled with ink; a nozzle plate 11 disposed at one end of each pressure generating chamber 17; a nozzle 15 for emitting ink drops 19, the nozzle 15 being formed in the nozzle plate 11 so as to correspond to each pressure generating chamber 17; a piezoelectric actuator 14, disposed to correspond to each pressure generating chamber 17, and used to vibrate the pressure generating chamber 17 via a vibration plate 13 and to emit ink from the nozzle 15 by a change in the capacity of the pressure generating chamber 17, which is caused by the vibration applied thereto; and an ink chamber 18 communicating with the corresponding pressure generating chamber 17 and used to supply ink to the pressure generating chamber 17 via an ink supply path 16 from an ink tank (not shown).

In the foregoing configuration, when the piezoelectric actuator 14 is driven, pressure and vibration are applied to each pressure generating chamber 17 to thereby change the capacity of the pressure generating chamber 17 and force an ink drop 19 out of the nozzle 15. This ink drop 19 strikes against a recording medium such as recording paper, thus forming a dot on the recording medium. Continuously forming dots in such a manner allows printing of specific characters, images, or the like based on image data.

Figure 15:
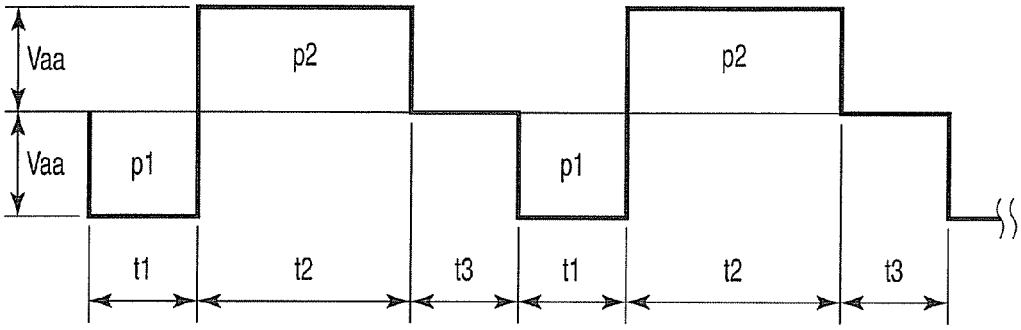
FIG. 15 shows the waveform of a drive pulse applied to a piezoelectric actuator.

FIG. 15 shows the waveform of a drive pulse Pd applied to each piezoelectric actuator 14. The drive pulse Pd includes: an expansion pulse p1 that expands the capacity of the pressure generating chamber 17; a contraction pulse p2 that contracts the capacity of the pressure generating chamber 17; and a quiescent time t3. In a multi-drop drive system, the drive pulse Pd is continuously generated so as to match the number of ink drops to be emitted.

However, driving the piezoelectric actuator 14 by the multi-drop system using the foregoing drive pulse Pd suffers from degradation in print quality.

Figure 16:
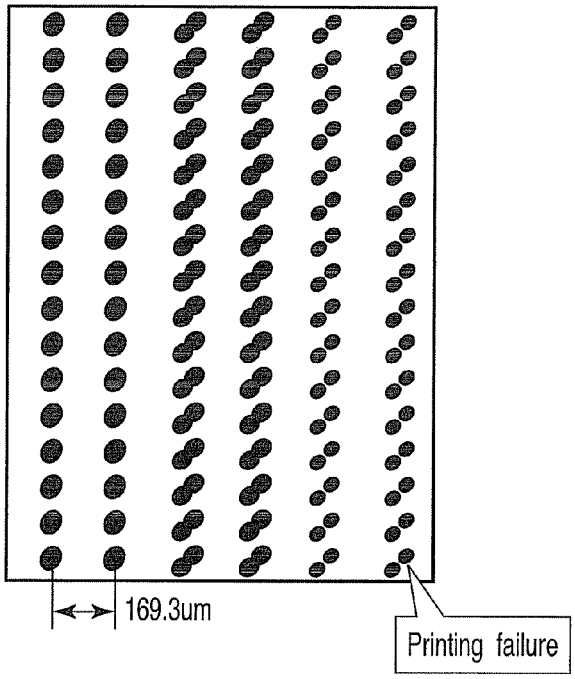
FIG. 16 is an enlarged view of dot shapes in two-drop printing.

FIG. 16 is an enlarged view of dot shapes in two-drop printing. As is apparent from FIG. 16, a first drop and a second drop are separated. The degrees of separation vary among the pairs of drops. This phenomenon does not arise in, for example, five-drop printing, which is high gradation printing.

The inventors researched and studied the factors of the foregoing degradation in print quality and interpreted the results as follows: the reason why drops of ink do not join when continuously emitted is considered to be because each ink drop is affected by the residual pressure of an ink drop emitted previously, with the result that a difference in emission speed between drops increases and hence striking of drops ceases to be uniform.

In order to verify this interpretation, ink drops are emitted by the multi-drop drive method and the number of drops and the emission speed of ink drops were measured. The measurements were made in a multi-nozzle drive mode, in which heads adjacent to each other are simultaneously driven, and in a single-nozzle mode, in which heads adjacent to each other are not simultaneously driven. This is because the foregoing degradation in print quality arises in the multi-nozzle drive mode but does not arise in the single-nozzle drive mode. Incidentally, a drive waveform as shown in FIG. 15 is used for the multi-drop drive.

Figures 1, 2:
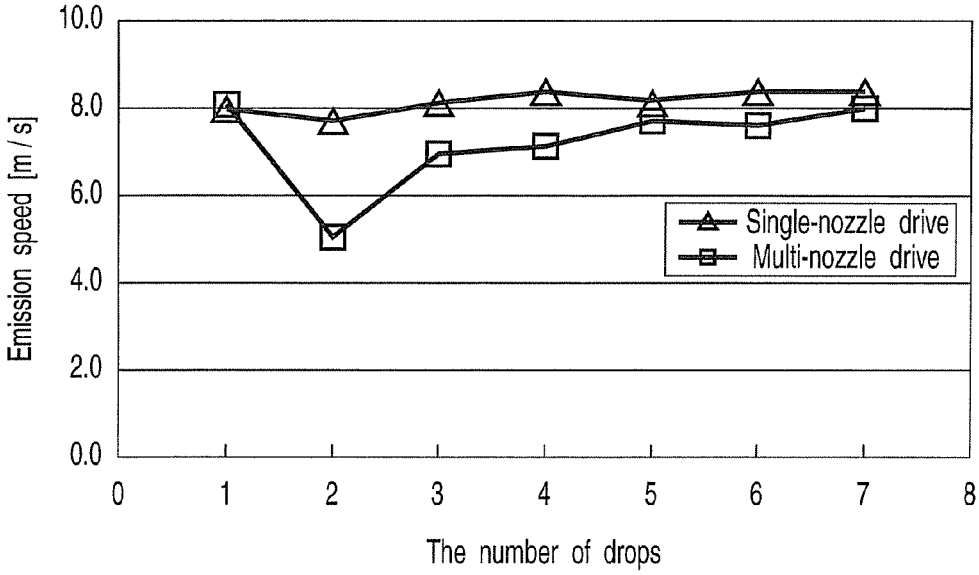
FIG. 1 is a diagram representing interrelations between the number of ink drops and the emission speed of individual ink drops.
FIG. 2 is a diagram showing measured emission speeds.

FIG. 1 is a diagram representing the interrelations between the number of drops and the emission speed of an ink drop, and FIG. 2 is a table showing the measured emission speeds.

As is understood from the result of these measurements, in an inkjet recording head 1 that has produced a defect, there is a large difference in emission speed between the first and second drops in the multi-nozzle drive mode, unlike the single-nozzle drive mode in this respect. Further, in the multi-nozzle drive mode, the emission speed of the second drop is lower than that of the first drop.

From the results of the measurements, it is verified whether the difference in emission speed is a contributing factor in the print defect described above.

The process of calculating any difference in striking position between the first and second drops will now be described. FIG. 3A shows various given values used in the calculation, and FIG. 3B shows values obtained by the calculation.

The values shown in FIG. 3A are assigned to: the emission speed V1 of a first drop of ink; the emission speed V2 of a second drop of ink; the distance by which a drop of ink is projected, which is the distance GAP between the print head and printing medium; a period DC for which one drop is emitted; and the conveyance speed V of the printing medium.

The projecting time T1*d* of a first drop of ink and the projecting time T2*d* of a second drop of ink are expressed by the equations (1) and (2).

$$T1d = \mathrm{GAP}/V1 = 123.5\mu s \quad \text{equation (1)}$$

$$T2d = \mathrm{GAP}/V2 = 200.0\mu s \quad \text{equation (2)}$$

A delay T when a drop strikes against a recording medium, which is the difference between when a first drop of ink strikes and when a second drop of ink strikes is expressed by the equation (3).

$$\text{Delay } T = T2d + DC - T1d = 83.8\mu s \quad \text{equation (3)}$$

Accordingly, the difference L in striking position between the first and second drops of ink is expressed by the equation (4).

$$L = V \times \text{delay } T = 34\mu m \quad \text{equation (4)}$$

The diameter of the dot formed when one drop of ink strikes the printing medium is approximately equal to the difference L in striking position. Therefore, studies indicate that the difference in striking position is significant.

In a regular multi-drop drive, second and subsequent drops of ink can be accelerated beyond the emission speed of the first drop by utilizing residual pressure vibrations of previously emitted drops of ink. Compared to these drops, the first drop of ink is lower in emission speed than the second and subsequent drops because pressure and vibration are applied to the pressure generating chamber from a state in which the meniscus is stationary.

Therefore, regular emission is characterized by such emission speed increase with the number of drops. Specifically, the emission speed of a first drop of ink is normally low, that of a second drop is higher than that of the first drop, that of a third drop is higher than that of the second drop, and so on.

However, in an inkjet head producing defects as described above, the emission speed of a first drop is higher than that of a second drop.

Accordingly, it is understood that the projecting time T2*d* for a second drop of ink is longer than the projecting time T1*d* for the first drop of ink. This leads to a large difference in delay T when a drop strikes against a recording medium, which is expressed by the equation (3).

In the single-nozzle drive mode, the emission speed of a second drop of ink tends to be lower than that of a first drop of ink. However, the difference between them is small.

In the multi-nozzle drive mode, the difference in emission speed is large, which is because each nozzle is affected by the expansion of any nozzle adjacent to it. Also for the same reason, the degree of separation of dots varies among the nozzles.

From the foregoing considerations, the measurement results show that the main factor in the printing failure described above is a large difference in emission speed. In particular, the fact that the emission speed V1 of a first drop of ink is higher than the emission speed V2 of a second drop contributes to the printing failure.

In order to combat degradation in print quality by eliminating the foregoing emission speed difference, it is proposed to alter the drive waveform of the inkjet head.

However, the drive waveform used has been obtained by adjusting the time t1 for which the expansion pulse P1 is continued, the time t2 for which the contraction pulse p2 is continued, and the quiescent time t3, based on a reference drive waveform.

That is, the drive waveform is determined by comprehensively evaluating image quality of prints to be yielded (e.g., gradation reproducibility in each print mode), printing speed, consumption power, etc. Therefore, even if the foregoing print failure is eliminated by re-adjusting the drive waveform, another requirement might not be satisfied.

As a result of the research and study discussed above, the inventors have found a method that allows the deceleration of the emission speed of a first drop of ink below that of a second drop without altering the drive waveform, or allows a reduction in difference between the emission speed of first and second drops, thereby eliminating the foregoing printing failure.

An embodiment according to the present invention will hereinafter be described with reference to the accompanying drawings.

Figure 4:
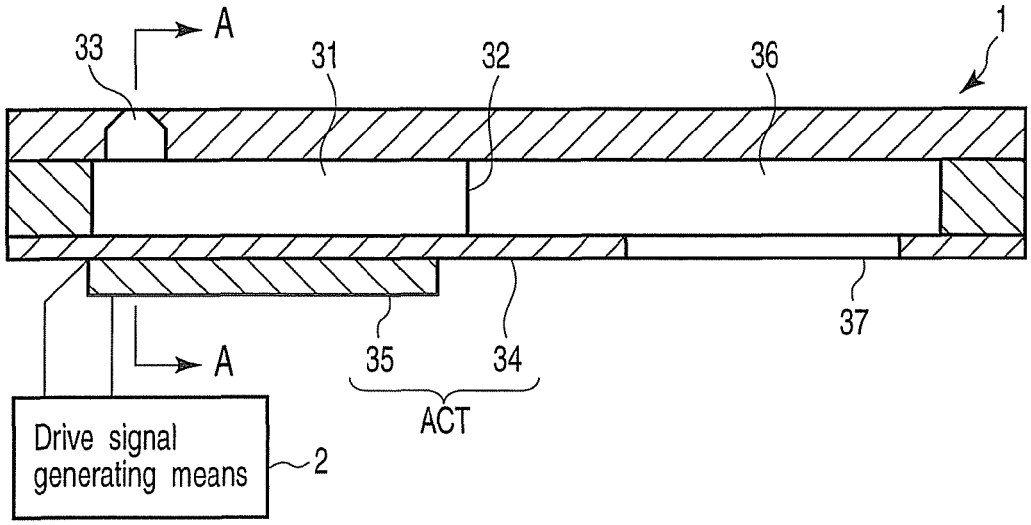
FIG. 4 is a view showing the configuration of a main part of an inkjet head.
Figure 5:
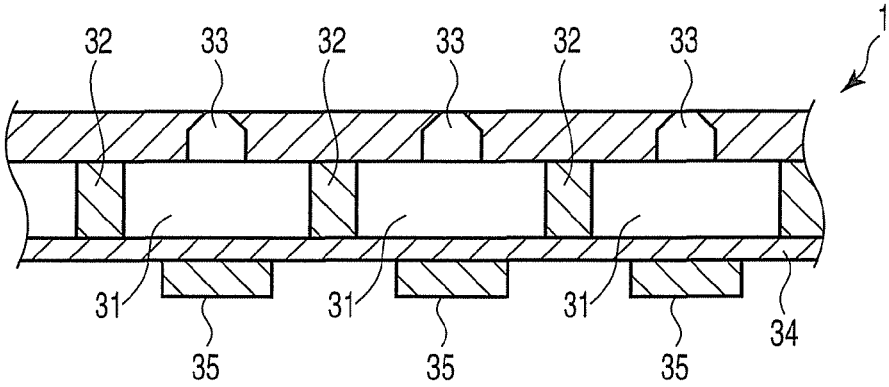
FIG. 5 is another view showing the configuration of the main part of the inkjet head.

FIGS. 4 and 5 show the configuration of the main part of the inkjet head. FIG. 5 is a sectional view taken along the line A-A of FIG. 4.

Referring to FIGS. 4 and 5, the inkjet head 1 has a plurality of pressure chambers 31 for storing ink separated by partitions 32, and each pressure chamber 31 is provided with a nozzle 33 for emitting drops of ink.

The bottom of each pressure chamber 31 is formed from a vibration plate 34. A plurality of piezoelectric members 35 are fixed to the underside of the vibration plate 34 so as to correspond to the pressure chambers 31. The vibration plate 34 and piezoelectric member 35 compose an actuator ACT, and the piezoelectric member 35 is electrically connected to an output terminal of the drive signal generating means 2.

Formed in the inkjet head 1 is a common pressure chamber 36 communicating with each pressure chamber 31. Ink is injected into the common pressure chamber 36 from ink supply means (not shown) via an ink supply port 37, thereby filling the common pressure chamber 36, each pressure chamber 31 and each nozzle 33 with ink. Since the pressure chambers 31 and the corresponding nozzles 33 are filled with ink, ink meniscus are formed within the nozzles 33.

Figure 6:
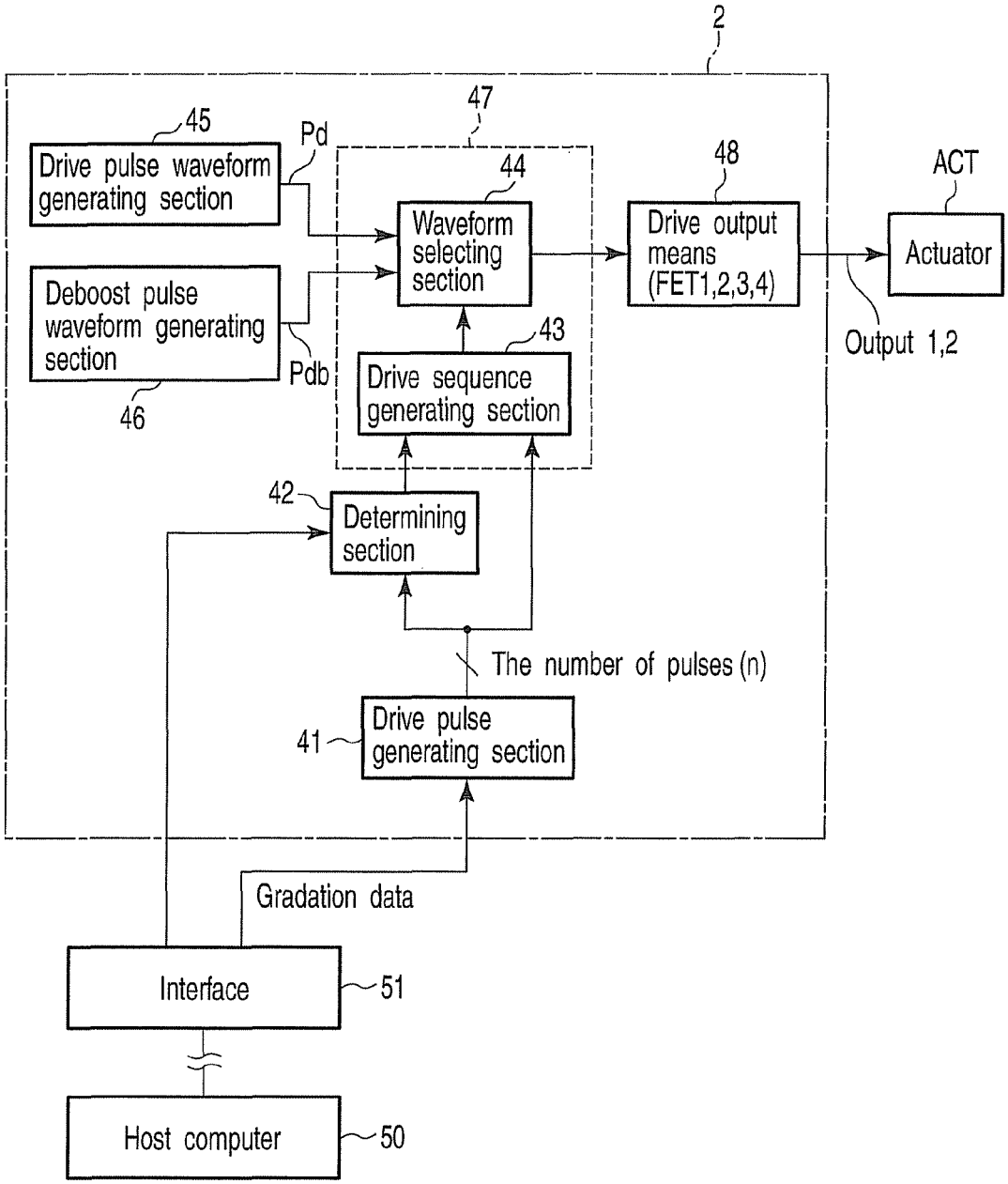
FIG. 6 is a view showing drive signal generating means in detail.

Referring to FIG. 6, the configuration of the drive signal generating means 2 will hereinafter be described in detail. A drive pulse generating section 41 shown in FIG. 6 generates the number of drive pulses (n) based on print gradation data input from, for example, a host computer 50 via an interface 51. The number of drive pulses (n) equals the number of ink drops.

The number of drive pulses (n) output from the drive pulse generating section 41 is transmitted to a determining section 42, where a determination is made whether (n) is equal to or greater than a predetermined number N (wherein, $1<N\leqq M$, and M is the number of ink drops at maximum gradation). In this case, the number of ink drops M at the maximum gradation is set to "7" and the predetermined number N is set to, for example, "4". Any value that falls within the range of $1<N\leqq M$ suffices for use as the predetermined number N stored in advance in the determining section 42, and can be externally altered from the operation panel of an inkjet recorder or host computer (e.g., host computer 50) via the interface 51.

The result of the determination by the determining section 42 is output to a drive sequence generating section 43. The drive sequence generating section 43 receives the input of the number of drive pulses (n) generated by the drive pulse generating section 41.

The drive sequence generating section 43 controls the selection of a waveform by a waveform selecting section 44. The waveform selecting section 44 receives a drive pulse Pd (see FIG. 7) output from a drive pulse waveform generating section 45, and a deboost pulse Pdb (see FIG. 8) output from a deboost pulse waveform generating section 46. The drive sequence generating section 43 and the waveform selecting section 44 compose a waveform output section 47.

If the number of drive pulses (n) is smaller than the predetermined number N (=4), that is, three or fewer, the drive sequence generating section 43 controls the waveform selecting section 44 such that the waveform output section 47 selects and outputs the deboost pulse Pdb one time and then selects and outputs the drive pulse Pd (n) number of times.

If the number of drive pulses (n) is equal to or greater than the predetermined number (=4), the drive sequence generating section 43 controls the waveform selecting section 44 to select and output the drive pulse Pd (n) number of times.

The waveform output from the waveform selecting section 44 is output to drive output means 48. Then, an output 1 and an output 2 from the drive output means 48 are connected to the actuator ACT.

Incidentally, a partial deboost system refers to a system that adds a deboost pulse Pdb if the number of drive pulses (n) is smaller than the predetermined number N or hinders the selection of the deboost pulse Pdb if the number of drive pulses (n) is equal to or greater than the predetermined number N. Reasons for adopting the partial deboost system will be described later in detail.

Figure 7:
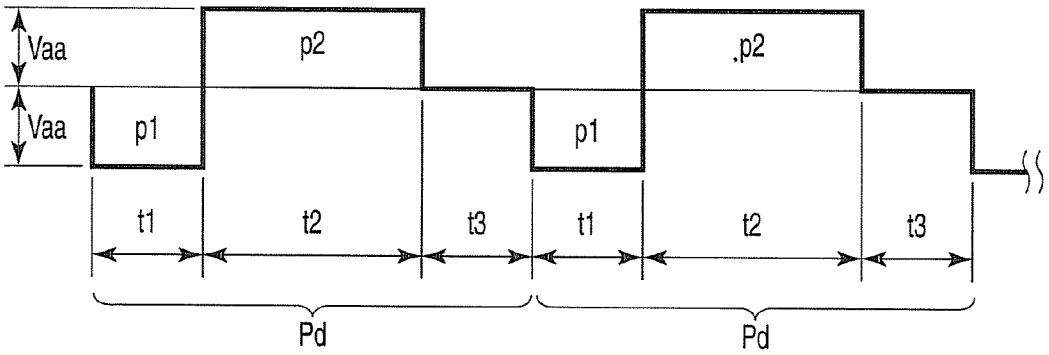
FIG. 7 shows a waveform of a drive pulse generated by the drive signal generating means.

With reference to FIG. 7, there will next be described the waveform of the drive pulse Pd generated by the drive signal generating means 2. This drive pulse Pd includes the expansion pulse p1 for expanding the capacity of each pressure chamber 31, the contraction pulse p2 for contracting the capacity of the pressure chamber 31, and a quiescent time t3. The expansion pulse p1 is a rectangular wave of negative polarity with pulse width t1 and voltage amplitude Vaa, and the contraction pulse p2 is a rectangular wave of positive polarity with pulse width t2 and voltage amplitude Vaa, which is identical to the expansion pulse p1.

In the multi-drop drive system, a number of drive pulses Pd equal to the number of ink drops to be emitted are generated in succession.

If pressure propagation time, which is the time required for the pressure wave of ink to propagate from the common pressure chamber at the rear end to the nozzle leading end, is assumed to be AL (Acoustic Length), the pulse width t1 of the expansion pulse p1 is set to approximately AL and the pulse width t2 of the contraction pulse p2 is set in the range of 1.5 to 2 AL. The quiescent time t3 is set in the range of 0 to AL. AL is the unit of time. At this time interval, pressure in the pressure chamber 31 changes from positive to negative or from negative to positive.

Figure 9:
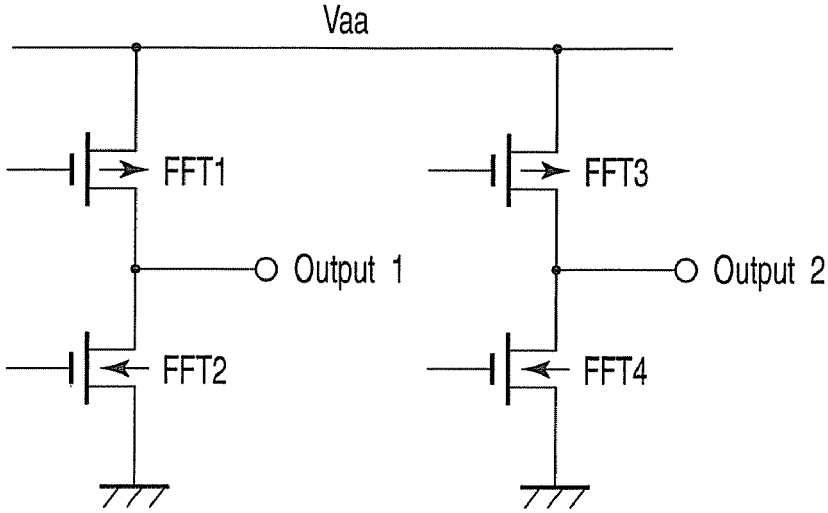
FIG. 9 is shows part of a circuit of the drive signal generating means.

FIG. 9 shows part of a circuit of the drive signal generating means 2.

Between a Vaa power source terminal and a ground terminal is a series circuit connecting FET1 and FET2. The output 1 from a point connecting the FET 1 and FET2 is connected to one electrode terminal of the piezoelectric member 35. Similarly, between the Vaa power source terminal and the ground terminal is a series circuit connecting FET3 and FET4. The output 2 from a point connecting the FET 3 and FET4 is connected to the other electrode terminal of the piezoelectric member 35.

To apply the expansion pulse p1 as shown in FIG. 7, the FET 1 and FET 4 are turned on while the FET 2 and FET 3 are turned off. To apply the contraction pulse p2, the FET2 and FET3 are turned on while the FET1 and FET 4 are turned off. By such operations, the voltage applied to the piezoelectric member is switched.

Figure 10:
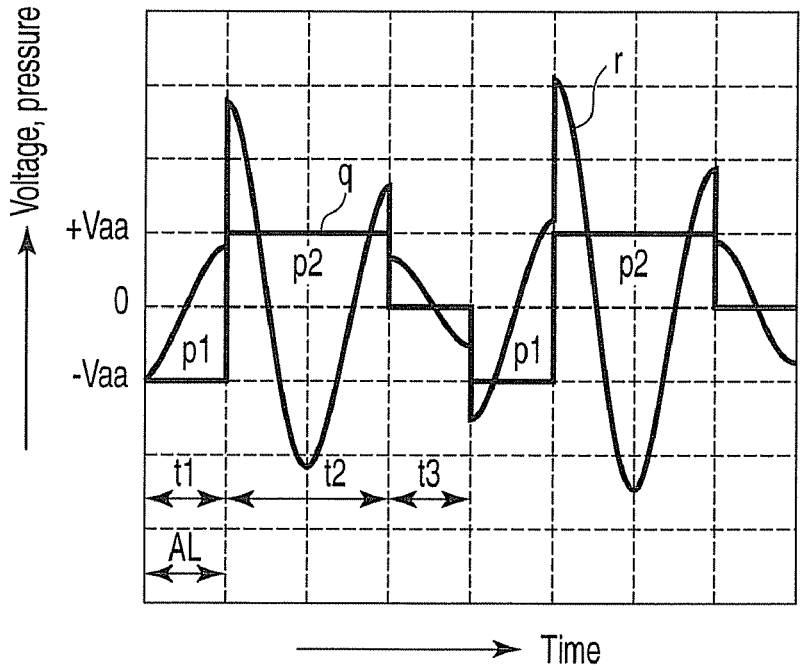
FIG. 10 shows a power supply waveform applied to a pressure chamber when the drive pulse is applied, and a pressure vibration waveform generated in the pressure chamber.

Referring to FIG. 10, there will next be described a power supply waveform (q) applied to each pressure chamber 31 when the drive pulse Pd is applied, and a pressure vibration waveform (r) generated in the pressure chamber 31. In this case, the pulse width t1 of the expansion pulse p1 in the figure is set to time AL required for a pressure wave generated inside the pressure chamber 31 to propagate from one end of it to the other. The pulse width t2 of the contraction pulse p2 is set to 2 AL, which is twice the pulse width t1, and the quiescent time t3 is also set to AL.

First, when a voltage −Vaa is applied between the electrodes of the piezoelectric member 35, the piezoelectric member 35 is deformed such that the capacity of the pressure chamber 31 suddenly increases. Consequently, negative pressure is instantaneously produced in the pressure chamber 31. After the pressure propagation time AL elapses, this pressure is inverted to positive pressure.

Next, when a voltage +Vaa having the opposite polarity is applied between the electrodes of the piezoelectric member 35, the piezoelectric member 35 is deformed such that the capacity of the pressure chamber 35 suddenly decreases from its increased state. Consequently, positive pressure is instantaneously produced in the pressure chamber 31. The pressure wave generated by this pressure is identical in phase to the pressure wave first generated and, the amplitude of the pressure wave suddenly increases accordingly. At this moment, a drop of ink is emitted from the nozzle.

If the time 2 AL, which is twice the pressure propagation time, elapses, the pressure in the pressure chamber 31 changes from positive to negative and then to positive again. By returning the voltage between the electrodes of the piezoelectric member 35 to zero at this moment, the capacity 31 of the contracted pressure chamber suddenly returns to its original state and the pressure in the pressure chamber 31 instantaneously decreases. This diminishes the amplitude of the pressure wave and hence residual pressure vibration.

Further, during the quiescent time AL, the pressure vibration changes from positive to negative. However, by applying the expansion pulse p1 for a second drop subsequent to the quiescent time AL, the capacity of the pressure chamber 31 suddenly increases and negative pressure is instantaneously applied to the pressure chamber 31 again. At this moment, the subsequent pressure vibration is applied while the pressure vibration for the first drop still remains. This makes negative pressure in the pressure chamber 31 greater than that for the first drop.

Accordingly, the positive pressure, to which the pressure in the chamber 31 is inverted after the subsequent elapse of the pressure propagation time AL, becomes higher. As a result, pressure required to emit the second drop by the application of the contraction pulse p2 is higher than that required to emit the first drop.

As described above, changing time to t1, t2, and t3 changes pressure required to emit an ink drop, and hence the emission speed of the ink drop.

Figure 8:
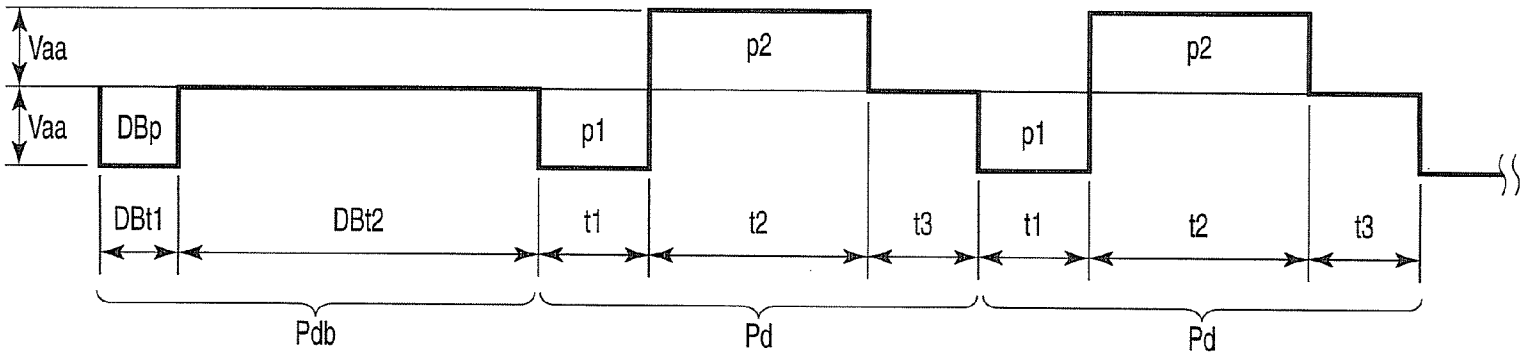
FIG. 8 shows a waveform in which a deboost pulse is added before a drive pulse for a first drop of ink is applied.

Referring to FIG. 8, there will next be described a waveform in which a deboost pulse Pdb is added before the drive pulse Pd generated for a first drop.

The deboost pulse Pdb includes an expansion pulse DBp that expands the capacity of the pressure chamber 31, and a quiescent time DBt2. The deboost pulse Pdb is a rectangular wave and the pulse width of the expansion pulse DBp is DBt1 and the voltage amplitude thereof is −Vaa. A drive pulse Pd following the deboost pulse Pdb and used for second or subsequent drops is identical to the drive pulse Pd shown in FIG. 7.

Since the deboost pulse Pdb expands the capacity of the pressure chamber 31, pressure in the pressure chamber 31 decreases. During the quiescent time DBt2, pressure in the pressure chamber 31 repeats the vibration of positive to negative. However, changing the pulse width DBt1 of the deboost pulse Pdb makes it possible to decrease initial pressure in the pressure chamber 31 when that drive for a first drop is initiated.

Whereas a so-called boost pulse refers to a pulse utilized to increase initial pressure in the pressure chamber 31, a deboost pulse refers to a pulse utilized to decrease it.

There will next be described a manner of determining the pulse width DBt1 of the expansion pulse DBp of the deboost pulse Pdb.

Figure 11:
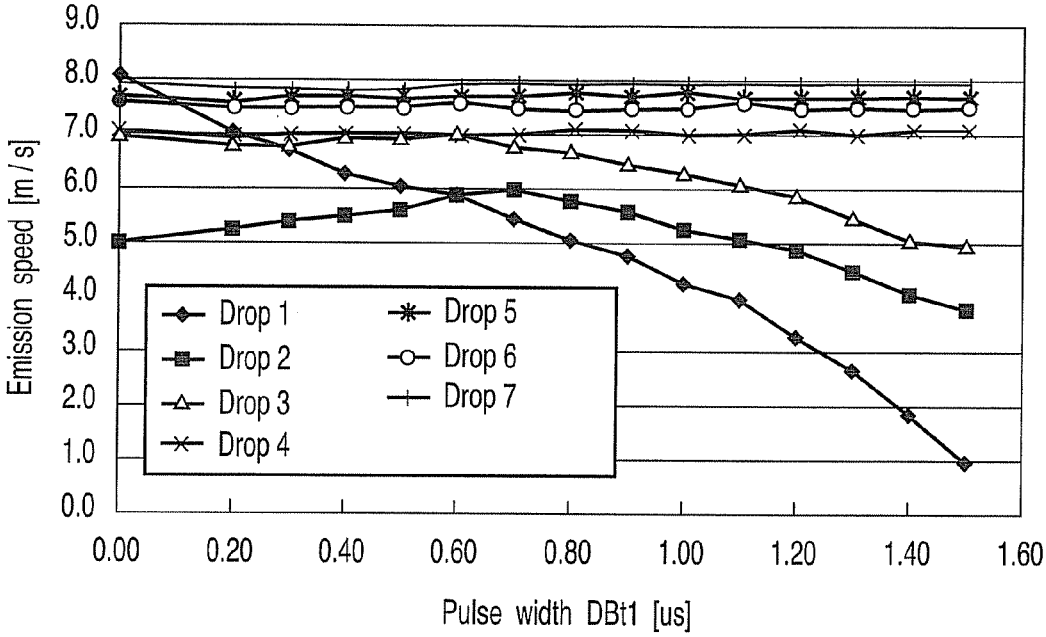
FIG. 11 is a diagram representing the measurements of an interrelation between and a pulse width of an expansion pulse and the emission speed of an ink drop.

FIG. 11 is a diagram representing the measurements of an interrelation between the pulse width DBt1 of the expansion pulse DBp and the emission speed of an ink drop. These measurements have been made in the multi-nozzle drive mode.

As the pulse width DBt1 increases, the emission speed of a first drop of ink decreases. On the other hand, as the pulse width DBt1 increases, the emission speed of a second drop of ink increases, describing a curve. The emission speed of a third drop of ink does not change at the beginning of an increase in the pulse width DBt1, but decreases as the pulse width DBt1 further increases.

As for the emission speeds of the fourth to seventh drops of ink, almost no changes are found even when the pulse width DBt1 increases.

From these measurements it is clear that appropriate selection of the pulse width DBt1 decelerates the emission speed of a first drop of ink below that of a second drop, reduces the difference in emission speed between the first and second drops of ink and, in addition, reduces the likelihood of an emission speed's being affected by a deboost pulse as the number of drops increases.

This means that to prevent any printing failure described above, the pulse width DBt1 must be set to a value for which the difference in emission speed between the first and second drops of ink is smallest.

Figure 12:
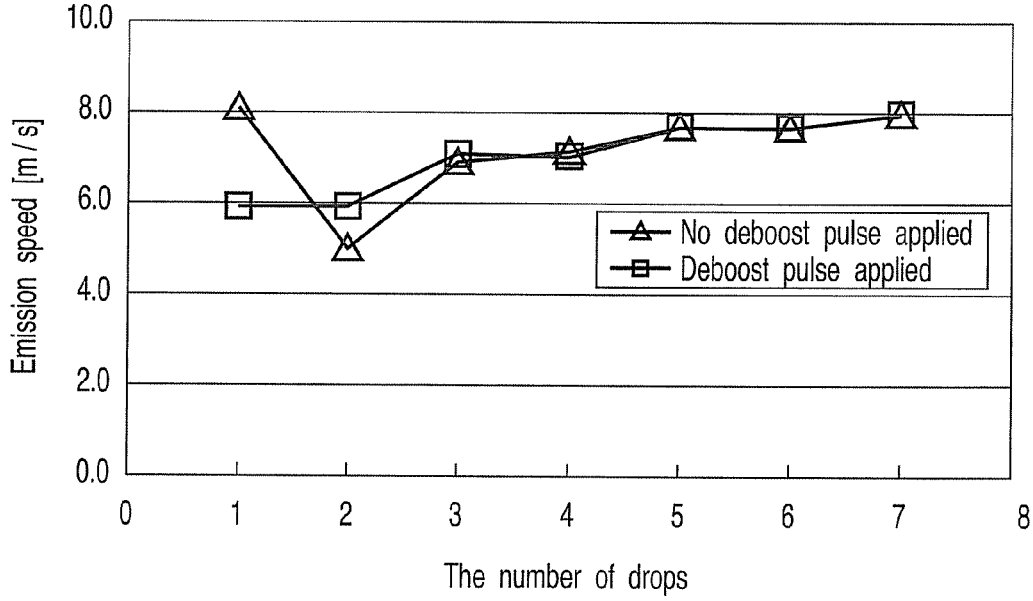
FIG. 12 is a diagram representing the interrelation between the number of drops and emission speed where a deboost pulse is applied before a drive pulse for a first drop is applied, and the interrelation between the number of drops and emission speed where the deboost pulse is not applied.

FIG. 12 is a diagram representing the interrelation between the number of drops and emission speed where a deboost pulse Pdb is applied before a drive pulse Pd for a first drop is applied in a seven-drop, eight-gradation multi-drop driving system, and the interrelation between the number of drops and emission speed where the deboost pulse Pdb is not applied.

This diagram represents results obtained when the pulse width DBt1 of the deboost pulse is set to 0.6 μs. Applying the deboost pulse Pdb allows the emission speed of the first drop of ink to be substantially equal to that of the second drop. The difference between the emission speed of a fourth drop of ink when the deboost pulse Pdb is applied and that when it is not applied is small. In addition, the emission speeds of the fifth to seventh drops of ink when the deboost pulse Pdb is applied are substantially equal to those when it is not applied.

Figure 13:
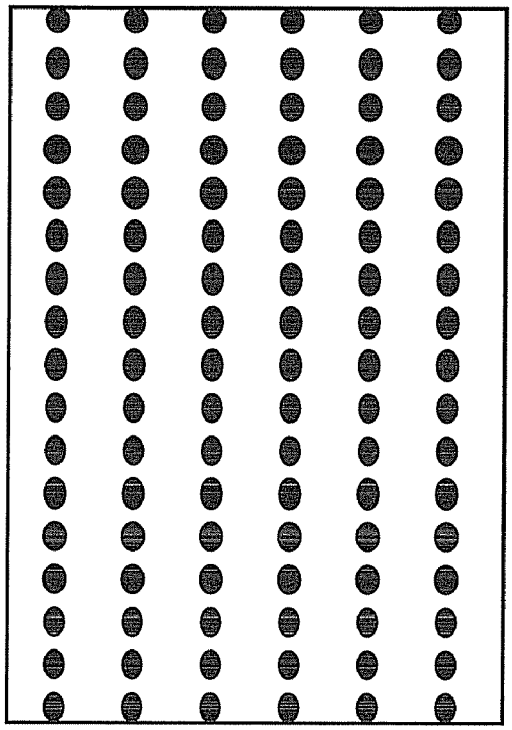
FIG. 13 shows the effect of the deboost pulse.

FIG. 13 shows the effect of the deboost pulse Pdb, specifically, an enlarged view of dot shapes obtained as a result of two-drop printing conducted after the application of the deboost pulse Pdb. As is clear from FIG. 13, print is yielded without causing separation of first and second drops of ink.

Using the deboost pulse Pdb in a manner as described above prevents print quality from being degraded by first few drops.

In conventional defects in view of which the present invention was made, first and second drops of ink are separated in two-drop printing, whereas first and second drops of ink are not separated in high gradation printing such as printing with five gradations.

This is because, in high gradation printing, the number of drops is larger and hence the dot diameter is larger, and dot separation, which is more likely to occur when the number of drops is small, is eliminated by the subsequent drops.

Accordingly, adopting the partial deboost method yields an outstanding effect, in other words, the effect of the deboost pulse Pdb. Specifically, deboost pulses Pdb are applied only for printing with first to third drops of ink, and a deboost pulse is not applied in printing with, for example, a fourth or subsequent drops of ink because the effect of deboost pulses is then minimal. This minimizes any power consumption increase and avoids decrease in printing speed.

The number of drops that is little affected by the application of deboost pulse Pdb depends upon the shapes of the pressure generating chamber and nozzle, the physical properties of the ink, the drive pulse shape, and so on. Therefore, taking account of these, the number of drops subject to the application of deboost pulse Pdb may be specified.

In order to achieve the partial deboost method described above, when the number of drive pulses (n) is smaller than the predetermined number N (=4), that is, three or fewer, the drive signal generating means 2 selects a deboost pulse Pdb once only and then outputs a drive pulse Pd to the actuator ACT the number of times (n). When the number of drive pulses (n) is equal to or greater than the predetermined number N (=4), the drive signal generating means 2 selects and outputs a drive pulse Pd to the actuator ACT the number of times (n).

In the foregoing embodiment, the period of the deboost pulse Pdb is set equal to that of the drive pulse Pd, but the invention is not limited thereto.

In addition, the deboost pulse Pdb shown in FIG. 8 is an expansion pulse that expands the capacity of the pressure chamber 31. However, the invention is not limited thereto and the deboost pulse Pdb may be a compression pulse that contracts the capacity of the pressure chamber 31.

The deboost pulse is used to decrease initial pressure in the pressure chamber 31 when the drive of a first drop of ink is initiated. The optimum deboost pulse varies according to a deboost pulse period, the shape of the pressure generating chamber and the nozzle, the physical properties of the ink, etc. and, therefore, allows the deboost pulse Pdb to be used as a compression pulse as well.

Each function described in the foregoing embodiment may be realized using hardware. Alternatively, using software, a computer may read and execute a program for each function. Additionally, each function may select software or hardware as necessity requires.

Further, a computer may read a program stored in a recording medium (not shown), thereby performing each function. In this embodiment, any recording medium capable of recording a program and being read by a computer suffices regardless of the type thereof.

It is to be understood that the present invention is not limited to the foregoing embodiment, and changes and variations may be made by modifying the components without departing from the scope of the invention. The invention can also be variously realized by combinations of the components disclosed in the foregoing embodiment. For example, some of the components in the foregoing embodiment may be deleted from all the components, or the components in different embodiments may be combined as necessity requires.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An inkjet head driving apparatus which drives an inkjet head for use in gradation printing which is performed to cause a capacity of each of a plurality of pressure chambers filled with ink to be changed by a drive pulse applied to an actuator, an ink drop to be emitted onto a recording medium from a nozzle communicating with the corresponding pressure chamber, and the number of ink drops emitted to be controlled according to the number of drive pulses, the driving apparatus comprising:

a drive signal generating section which, when the number of the ink drops is smaller than a predetermined number N (wherein $1<N\leqq M$, and M is the number of ink drops at the maximum gradation), applies a deboost pulse to decrease pressure in the pressure chamber before the drive pulse for emitting a first drop of ink is applied and, when the number of the ink drops is equal to or greater than the predetermined number N, does not apply the deboost pulse, wherein the deboost pulse includes an expansion pulse applied to expand the capacity of the pressure chamber for a predetermined length of time or a contraction pulse applied to contract the capacity of the pressure chamber for a predetermined length of time, and a quiescent time following the expansion or contraction pulse.

2. The inkjet head driving apparatus according to claim 1, wherein the drive signal generating section comprises:

a drive pulse generating section which generates drive pulses;

a determining section which determines whether the number of the drive pulses generated by the drive pulse generating section is equal to or greater than a predetermined number N (wherein $1<N\leqq M$, and M is the number of ink drops at the maximum gradation) stored in advance; and a pulse applying section which, when the determining section determines that the number of the drive pulses is smaller than the predetermined number N, applies the drive pulses to the actuator subsequent to the deboost pulse and, when the determining section determines that the number of the drive pulses is equal to or greater than the predetermined number N, applies the drive pulses to the actuator.

3. The inkjet head driving apparatus according to claim 2, wherein the predetermined number N is stored in advance and externally altered.

4. The inkjet head driving apparatus according to claim 3, wherein when the deboost pulse is applied, an emission speed of a first drop of ink is equal to or lower than that of a second drop of ink and when the deboost pulse is not applied, the emission speed of the first drop of ink is higher than that of the second drop of ink.

5. The inkjet head driving apparatus according to claim 4, wherein when the deboost pulse is applied, the emission speed of the first drop of ink is lower than that when the deboost pulse is not applied and the emission speed of the second drop of ink is higher than that when the deboost pulse is not applied.

6. The inkjet head driving apparatus according to claim 5, wherein a period of the deboost pulse is substantially equal to a period of each drive pulse.

7. The inkjet head driving apparatus according to claim 3, wherein when the deboost pulse is applied, the emission speed of a first drop of ink is substantially equal to that of a second drop of ink and when the deboost pulse is not applied, the emission speed of the first drop of ink is higher than that of the second drop of ink.

8. The inkjet head driving apparatus according to claim 7, wherein when the deboost pulse is applied, the emission speed of the first drop of ink is lower than that when the deboost pulse is not applied, and the emission speed of the second drop of ink is higher than that when the deboost pulse is not applied.

9. The inkjet head driving apparatus according to claim 8, wherein a period of the deboost pulse is substantially equal to a period of each drive pulse.

10. An inkjet head driving apparatus which drives an inkjet head for use in gradation printing which is performed to cause a capacity of each of a plurality of pressure chambers filled with ink to be changed by a drive pulse applied to an actuator, an ink drop to be emitted onto a recording medium from a nozzle communicating with the corresponding pressure chamber, and the number of ink drops emitted to be controlled according to the number of drive pulses, the driving apparatus comprising:

drive signal generating means for, when the number of the ink drops is smaller than a predetermined number N (wherein $1<N\leqq M$, and M is the number of ink drops at the maximum gradation), applying a deboost pulse to decrease pressure in the pressure chamber before the drive pulse for emitting a first drop of ink is applied and, when the number of the ink drops is equal to or greater than the predetermined number N, applying no deboost pulse, wherein the deboost pulse includes an expansion pulse applied to expand the capacity of the pressure chamber for a predetermined length of time or a contraction pulse applied to contract the capacity of the pressure chamber for a predetermined length of time, and a quiescent time following the expansion or contraction pulse.

11. The inkjet head driving apparatus according to claim 10, wherein the drive signal generating means comprises:

drive pulse generating means for generating drive pulses;

determining means for determining whether the number of the drive pulses generated by the drive pulse generating means is equal to or greater than a predetermined number N (wherein $1<N\leqq M$, and M is the number of ink drops at the maximum gradation) stored in advance; and pulse applying means for, when the determining means determines that the number of the drive pulses is smaller than the predetermined number N, applying the drive pulses to the actuator subsequent to the deboost pulse and, when the determining means determines that the number of the drive pulses is equal to or greater than the predetermined number N, applying the drive pulses to the actuator.

12. The inkjet head driving apparatus according to claim 11, wherein the predetermined number N is stored in advance and externally altered.

13. The inkjet head driving apparatus according to claim 12, wherein when the deboost pulse is applied, an emission speed of a first drop of ink is equal to or lower than that of a second drop of ink and when the deboost pulse is not applied, the emission speed of the first drop of ink is higher than that of the second drop of ink.

14. The inkjet head driving apparatus according to claim 13, wherein when the deboost pulse is applied, the emission speed of the first drop of ink is lower than that when the deboost pulse is not applied and the emission speed of the second drop of ink is higher than that when the deboost pulse is not applied.

15. An inkjet head driving method for driving an inkjet head for use in gradation printing which is performed to cause a capacity of each of a plurality of pressure chambers filled with ink to be changed by a drive pulse applied to an actuator, an ink drop to be emitted onto a recording medium from a nozzle communicating with the corresponding pressure chamber, and the number of ink drops emitted to be controlled according to the number of drive pulses, the driving method comprising:

a drive signal generation step of, when the number of the ink drops is smaller than a predetermined number N (wherein $1<N\leqq M$, and M is the number of ink drops at the maximum gradation), applying a deboost pulse to decrease pressure in the pressure chamber before the drive pulse for emitting the first drop of ink is applied and, when the number of the ink drops is equal to or greater than the predetermined number N, applying no deboost pulse, wherein the deboost pulse includes an expansion pulse applied to expand the capacity of the pressure chamber for a predetermined length of time or a contraction pulse applied to contract the capacity of the pressure chamber for a predetermined length of time, and a quiescent time following the expansion or contraction pulse.

16. The inkjet head driving method according to claim 15, wherein the drive signal generation step comprises:

a drive pulse generation step of generating drive pulses;

a determination step of determining whether the number of the drive pulses generated in the drive pulse generation step is equal to or greater than a predetermined number N (wherein $1<N\leqq M$, and M is the number of ink drops at the maximum gradation) stored in advance; and a pulse application step of, when it is determined in the determination step that the number of the drive pulses is smaller than the predetermined number N, applying the drive pulses to the actuator subsequent to the deboost pulse, and when it is determined in the determination step that the number of drive pulses is equal to or greater than the predetermined number N, applying the drive pulses to the actuator.

17. The inkjet head driving method according to claim 16, wherein the predetermined number N is stored in advance and externally altered.

18. The inkjet head driving method according to claim 17, wherein when the deboost pulse is applied, an emission speed of a first drop of ink is equal to or lower than that of a second drop of ink and when the deboost pulse is not applied, the emission speed of the first drop of ink is higher than that of the second drop of ink.

19. The inkjet head driving method according to claim 18, wherein when the deboost pulse is applied, the emission speed of the first drop of ink is lower than that when the deboost pulse is not applied and the emission speed of the second drop of ink is higher than that when the deboost pulse is not applied.

20. The inkjet head driving method according to claim 19, wherein a period of the deboost pulse is substantially equal to a period of each drive pulse.

* * * * *